United States Patent [19]

Ewbank

[11] Patent Number: 4,755,154

[45] Date of Patent: Jul. 5, 1988

[54] VIBRATION ISOLATING MOUNT WITH SNUBBING MEANS

[75] Inventor: Michael E. Ewbank, Rockford, Ill.

[73] Assignee: Sundstrand Corporation, Rockford, Ill.

[21] Appl. No.: 944,759

[22] Filed: Dec. 22, 1986

[51] Int. Cl.[4] ..... B63H 1/15

[52] U.S. Cl. ..... 440/52; 248/560; 248/634

[58] Field of Search ..... 114/71, 20 R, 312; 440/52, 113; 248/557, 560, 608, 609, 634, 635, 638, 646

[56] References Cited

U.S. PATENT DOCUMENTS

| | | | |
|---|---|---|---|
| 2,044,713 | 6/1936 | Trott . | |
| 2,264,895 | 12/1941 | Starr . | |
| 2,644,420 | 7/1953 | Irgens | 248/609 |
| 2,830,780 | 4/1958 | Schloss . | |
| 2,891,743 | 6/1959 | Bligard et al. | 248/557 |
| 2,899,923 | 8/1959 | Daly et al. . | |
| 3,130,700 | 4/1964 | Peterson . | |
| 3,145,678 | 8/1964 | Shmorhun et al. . | |
| 4,463,454 | 7/1984 | Hemond et al. . | |
| 4,546,848 | 10/1985 | Iijima et al. | 248/560 |
| 4,645,190 | 2/1987 | Schad | 248/634 |

FOREIGN PATENT DOCUMENTS

| | | | |
|---|---|---|---|
| 2730606 | 1/1979 | Fed. Rep. of Germany | 114/71 |

*Primary Examiner*—Joseph F. Peters, Jr.
*Assistant Examiner*—Stephen P. Avila
*Attorney, Agent, or Firm*—Wood, Dalton, Phillips, Mason & Rowe

[57] ABSTRACT

Noise transmission problems in a torpedo or the like are avoided through the use of a vibration isolating mount 16 to mount various components to the hull 10. The mount 16 includes a generally vertical ring 60 having a vertical, axially facing surface 66 and mounting means 62 for mounting the ring to the hull 10 or the like. Also included is a generally vertical, annular yoke 76 having a vertical, axially facing surface 80 aligned with, spaced from and facing the ring surface 66 and having mounting means 92, 94 for securing the yoke to an object 14, 18 subject to vibration. At least one soft, elastomeric pad 90 extends horizontally between the ring 60 and the yoke 76, the pad 90 being disposed between the surfaces 66 and 80 and bonded thereto. The pad 90 will always be in shear to provide good attenuation and occasionally will be placed in tension or compression when relative movement between the ring 60 and the yoke 76 having an axial component occurs.

10 Claims, 2 Drawing Sheets

VIBRATION ISOLATING MOUNT WITH SNUBBING MEANS

FIELD OF THE INVENTION

This invention relates to a vibration isolating mount, and more particularly to a vibration isolating mount provided with an integral snubber. The mount is particularly suited for use in equipment requiring noiseless operation as, for example, a naval torpedo.

BACKGROUND OF THE INVENTION

As is well known, various types of equipment require noiseless operation for any of a variety of reasons. One example is a naval torpedo. If a naval torpedo does not run relatively noiselessly, it may be detected sufficiently early to allow defensive maneuvering to avoid the torpedo or permit the use of counter measures to destroy the torpedo before it finds its target. Consequently, it is highly desirable to provide a highly effective vibration isolating mount in a torpedo or the like for attenuating vibration from an object subject to vibration before the same is transmitted to a base such as the hull of a torpedo.

While many naval torpedoes are launched from vessels, not infrequently they may be launched from aircraft as well. In both cases, the same may experience substantial shock during launch or handling.

Because good design technique necessarily allows a certain degree of relative movement between various components in any piece of machinery to prevent vibration induced stress from causing failures, it is necessary that various torpedo components be mounted within the torpedo hull for slight relative movement with respect to other components and the hull as well. At the same time, the mounting must be such as to withstand the shock imparted to the torpedo hull and to the components therein as a result of intertial forces upon the torpedo impacting against the water when launched from the air.

Thus, it is highly desirable that some sort of movement limiting means be utilized in the mounting of torpedo components to absorb the shocks of airborne launching before damage to relatively movable components within the torpedo can occur.

The present invention is directed to achieving one or more of the above desirable features.

SUMMARY OF THE INVENTION

It is the principal object of the invention to provide a new and improved vibration isolating mount. More specifically, it is an object of the invention to provide such a mount to achieve excellent attenuating of vibration from an object being mounted on a base to thereby prevent the transmission of noise from the mounted object to the base.

According to one facet of the invention, there is provided a vibration isolating mount including a generally vertical ring having a vertical, axially facing surface and further having mounting means for mounting the ring to a base or the like. The mount further includes a generally vertical, annular yoke having a vertical, axially facing surface aligned with, spaced from the facing the ring surface and further having mounting means for securing to the yoke, an object subject to vibration. At least one soft elastomeric pad extends horizontally between the ring and the yoke with the pad being disposed between the surfaces and bonded thereto.

As a consequence of this construction, the pad will always be in shear and only placed in tension or compression when relative movement between the ring and the yoke occurs and then only when the relative movement has a substantial axial component. As a consequence, attenuation of vibration across the mount is at a miximum.

In a highly preferred embodiment, the yoke mounting means is constructed so as to mount objects on both sides of the yoke. As a consequence, the total mass of the mounted objects may be increased to a maximum and this in turn provides increased vibration attenuation across the mount.

In a highly preferred embodiment of the invention, a snubbing or relative movement limiting means are provided. According to this embodiment of the invention, one of the ring and the yoke includes a snubbing projection and the other of the ring and the yoke includes a snubber groove loosely receiving the projection.

According to another facet of the invention, there is provided a vibration isolating mount which includes a mounting ring having an axially facing surface, an annular yoke including an axially facing surface spaced from and facing the ring surface, with one of the ring and the yoke having a radially directed snubbing projection and the other of the ring and the yoke having an oppositely radially directed snubbing groove loosely receiving the projection. At least one elastomeric pad is disposed between and bonded to the surfaces and the ring and the yoke are provided with respective mounting means.

In a highly preferred embodiment, the projection is circumferential and the groove is peripheral and both are three sided. Each side on one faces, but is spaced from, a corresponding side on the other. The facing sides may abut each other upon relative movement between the ring and the yoke in excess of a predetermined amount to limit further relative movement both axially and radially and combinations thereof. In a highly preferred embodiment, one of the grooves and a projection, and preferably the projection, is provided with a covering of a material softer than either the projection of the yoke. Thus, when the yoke and ring are made of metal, metal to metal contact is avoided. Preferably, the soft material is a relatively hard elastomer.

In a highly preferred embodiment, the vibration isolating mount is incorporated in a torpedo having a hull with the ring being secured to the hull. At least two housings within the hull are on opposite sides of the yoke and are secured thereto by the mounting means associated therewith.

Other objects and advantages will become apparent from the following specification taken in connection with the accompanying drawings.

DESCRIPTION OF THE PREFERRED EMBODIMENT

Figure 1:
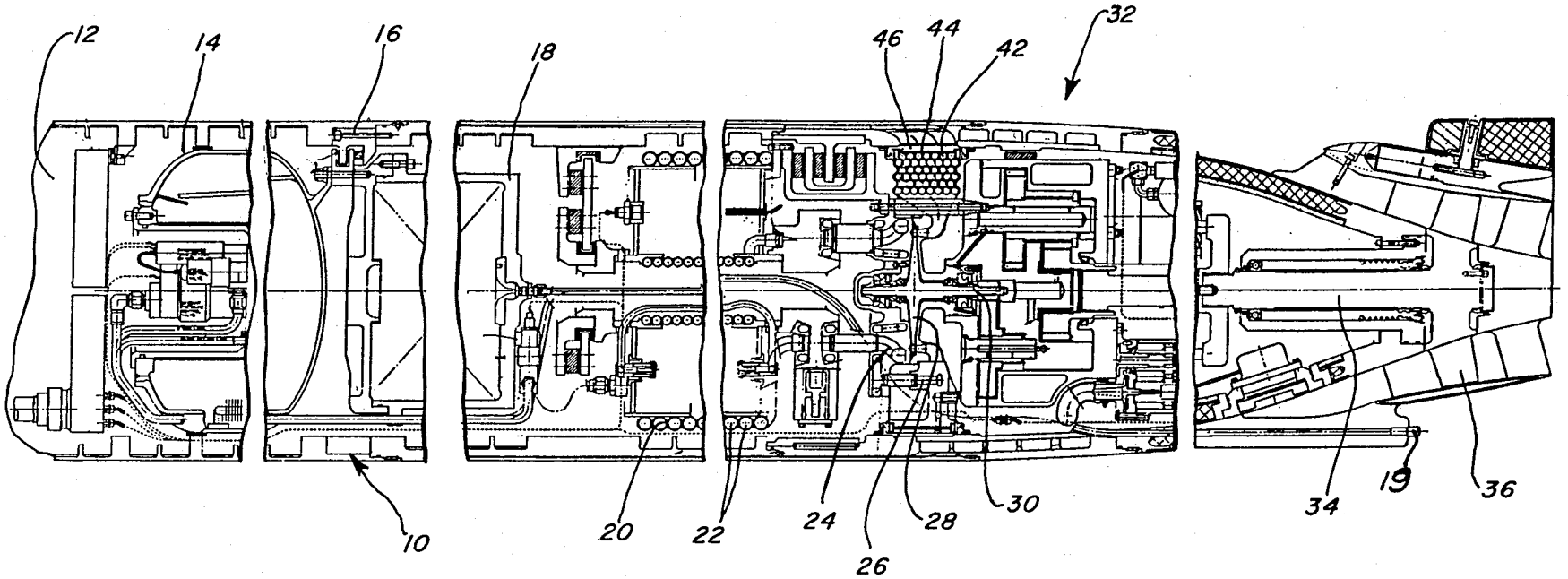
FIG. 1 is a sectional view of a torpedo embodying the invention.

An exemplary embodiment of a torpedo incorporating the invention is illustrated in FIG. 1 and with reference thereto is seen to include a hull, generally designated 10. A warhead (not shown) or the like may be attached at the forward end 12 of the hull.

Within the hull is a first housing on tank 14 which contains an oxidant for use in a chemical reaction by which heat is generated to vaporize a working fluid to drive the torpedo by means of a closed Rankine cycle system.

A vibration isolating mount 16 made according to the invention is utilized to mount the oxidant tank 14 as well as an adjacent end of a wire reel housing 18. Wire on the reel within the housing 18 may exit the torpedo via wire outlet 19. The wire is used for conventional control purposes.

Within the hull 10 is a boiler 20 which typically will contain the material to be oxidized as, for example, metallic lithium. When metallic lithium is utilized as the material to be oxidized, sulphur hexafluoride is typically contained within the tank 14.

As can be seen, the boiler 20 includes a plurality of coils 22 in which a working fluid, typically water, flows and is vaporized. By means of suitable conduits, the coils 22 are connected to the inlet manifold 24 of a turbine generally designated 26. The turbine 26 includes a turbine, wheel 28 having an output shaft 30 connected to a transmission, generally designated 32. The transmission 32 is in turn connected by any suitable means to a propulsion shaft 34 which in turn drives a propulsor 36 for the torpedo.

In the illustrated embodiment, the turbine 26 is an axial flow turbine but a turbine outlet housing 40 is utilized to direct flow radially outwardly to a heat exchanger 42 which acts as a regenerator in the closed Rankine cycle system which the torpedo employs. That is to say, the heat exchanger 42 receives spent working fluid from the turbine 26 which, in turn, passes radially outwardly through a plurality of coils 44. Flowing within the coils 44 is make up water to be supplied to the boiler 20. Flow is maintained by any suitable pump (not shown) through a power take-off from the turbine 26. The regenerator 42 has an annular, radially outwardly opening outlet 46 for the spent working fluid.

An elongated, relatively narrow space 48 between the hull 10 and an inner hull member 52 serves as a hull condenser. That is to say, the space 48 is in fluid communication with the outlet 46 of the regenerator to receive spent working fluid therefrom and condense the same by heat transfer through the hull 10 to the water in which the torpedo is traveling. The condensed working fluid is then collected by any suitable means and fed by the pump (not shown) through the regenerator 42 and then to the boiler 20 to be recycled.

Figure 2:
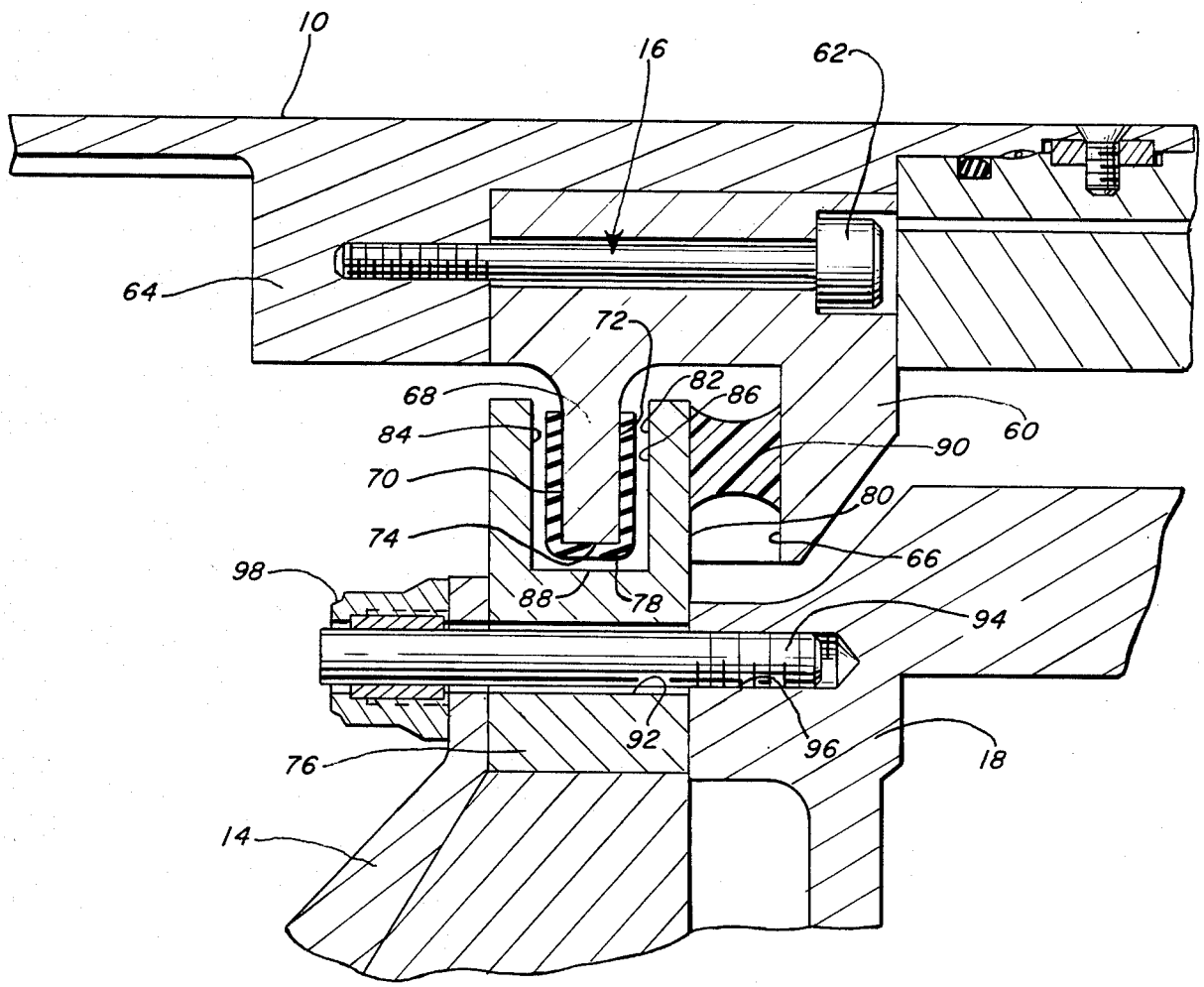
FIG. 2 is an enlarged, fragmentary sectional view of the vibration isolating mount of the invention.

With the foregoing general organization of the overall torpedo in mind, the vibration isolating mount of the present invention and shown generally at 16, will be described in connection with FIG. 2. The same includes a so-called bolt circle or mounting ring 60 which may be secured as by cap screws 62 (only one of which is shown) to an inwardly directed shoulder 64 forming part of the hull 10. The mounting ring 60 will typically be comprised of three or more segments. When three segments are used, each will have an arc length of approximately 120°.

The mounting ring 60 includes one axially facing surface 66 which, in its environment of intended use in a torpedo, will be in a vertical plane. Spaced from the surface 66 is a radially inwardly directed projection 68 used for snubbing purposes will be seen. The projection 68 is three sided and includes opposite axially facing surfaces 70 and 72 and a radially inwardly facing surface 74. These surfaces are coated with a material that is somewhat softer than the material of which the ring 60 or a yoke 76 are formed. In the typical case, a relatively hard rubber-like elastomer may be utilized to form what amounts to a U-shaped coating 78 about the sides 70, 72 and 74 of the projection 68.

Radially inwardly of the ring 60 is the annular yoke 76. As can be seen, the same has an axially facing, vertical surface 80 which is spaced from, aligned with and faces the axially facing surface 66 on the ring 60. Oppositely of the surface 80, the yoke 76 includes a radially outwardly opening groove 82. The groove 82 loosely receives the projection 68. The groove 82 is also three sided and has axially facing side walls 84 and 86 as well as a radially outwardly facing bottom 88. The groove 82 is peripheral about the yoke as the projection 68 is circumferential about the ring 60. It will be observed that the elastomer 74 on the projection 68 is spaced from the sides 84, 86 and the bottom 88 of the groove 82. This spacing corresponds to the maximum permitted relative movement, both axially and radially, of the yoke 76 relative to the ring 60 and thus the hull 10. Where the ring 60 and yoke 76 are made of metal, as will be typical, metal to metal contact is avoided through the use of the layer of elastomer 74.

Thus, the projection 68 and the groove 82 act as a relatively noiseless snubbing mechanism to prevent the shock of launches or handling from causing damage to the components by limiting relative movement of the components with respect to each other and to the hull.

At least one soft elastomeric pad 90 extends between the ring 60 and the yoke 76 and in particular, is located between the axially facing surfaces 66 and 80 and spans the distance between the two to be bonded by any suitable adhesive to each. Thus, the pad 90 extends horizontally from the ring 60 to the yoke 76.

In the usual case, there will be at least one of the pads 90 for each of the arc segments of which the ring 60 is made.

Returning to the yoke 76, the same includes a plurality of through bores 92 (only one is shown) in a generally horizontal plane. Each through bore 92 may receive a threaded fastener 92 which may be threaded into a threaded bore 96 in the wire reel housing 18 to secure the same to the yoke 76. By means of a threaded cap 98 on the opposite end of the threaded element 94, the oxidant tank 14 may likewise be secured to the yoke 76.

This construction provides a number of advantages. For one, in the usual attitude of the vibration isolating mount with the surfaces 66 and 80 vertical and the pad 90 extending horizontally, it will be appreciated that the pad 90 will always be in shear when no relative movement between the yoke 76 and the ring 60 is occurring. The only time the pad 90 will be placed in tension or compression will be when relative movement is occurring and such relative movement has an appreciable axial component. When the torpedo is operating, this will occur only upon speed changes as a result of the accompanying acceleration.

The modulus of elasticity of the elastomer forming the pad 90 will typically be less in shear than in either tension or compression. This in turn means that there is better attenuation of vibration across the mount because the pad 90 is always in shear and only upon certain types of relative movement will it be placed in either tension or compression.

Another feature of the invention is the ability to increase the mass of the suspended components, in the preferred embodiment, the reel housing 18 and the oxidant tank 14. This is enabled through the use of mounting surfaces on both sides of the yoke 76 and the use of a common mounting means in the form of threaded fasteners contacting both housings 14 and 18 simplifies the construction. Importantly, the ability to maximize the mass secured to the yoke 76 increases the attenuation across the mount as well. As a consequence, a highly effective vibration isolating mount with an integral snubbing device is provided.

I claim:

1. A vibration isolating mount comprising:

a mounting ring having an axially facing, vertical surface and a radially extending, circumferential snubbing projection spaced therefrom;

an annular yoke including a peripheral, radially opening groove of larger size than said projection and receiving said projection, said yoke further including an axially facing vertical surface spaced from and facing said ring surface;

at least one elastomeric pad extending horizontally between and bonded to said surfaces;

a material softer than either said projection or said yoke located within said groove on one of said projection and said groove; and mounting means on said yoke for mounting at least one component subject to vibration to said yoke;

said material on one of said projection and said groove being spaced from the other of said projection and said groove.

2. A vibration isolating mount comprising:

a mounting ring having an axially facing, vertical surface and a radially extending, circumferential snubbing projection spaced therefrom;

an annular yoke including a peripheral, radially opening groove of larger size than said projection and receiving said projection, said yoke further including an axially facing vertical surface spaced from and facing said ring surface;

at least one elastomeric pad extending horizontally between and bonded to said surfaces;

a material softer than either said projection of said yoke located within said groove on one of said projection and said groove; and mounting means on said yoke for mounting at least one component subject to vibration to said yoke;

both said projection and said groove being three sided with each side on one facing, but spaced from, a corresponding side of the other, said facing sides abutting each other upon relative movement between said ring and said yoke in excess of a predetermined amount to limit further relative movement both axially and radially and combination thereof.

3. A torpedo having a hull and including the mount of claim 1 with said ring being secured to said hull; and at least two housings within said hull on opposite sides of said yoke and secured thereto by said mounting means.

4. The vibration isolating mount of claim 1 wherein said mounting means is a common mounting means for mounting two said components, one on each side of said yoke.

5. The vibration isolating mount of claim 1 wherein said projection extends radially inwardly and said groove opens radially outwardly.

6. A vibration isolating mount comprising:

a mounting ring having an axially facing surface;

an annular yoke including an axially facing surface spaced from and facing said mounting ring surface;

one of said ring and said yoke having a radially directed snubbing projection;

the other of said ring and said yoke having an oppositely radially directed snubbing groove loosely receiving said projection;

at least one elastomeric pad between and bonded to said surfaces;

first mounting means on said ring for securing said ring to a base or the like; and second mounting means on said yoke for securing an object subject to vibration to said yoke.

7. The mount of claim 6 further including a layer of relatively hard elastomer on said projection.

8. A vibration isolating mount comprising:

a generally vertical ring having a vertical, axially facing surface and having mounting means for mounting said ring to a base or the like;

a generally vertical, annular yoke having a vertical, axially facing surface aligned with, spaced from and facing said ring surface and having mounting means for securing an object subject to vibration to the yoke; and at least one soft elastomeric pad extending horizontally between said ring and said yoke, said pad being disposed between said surfaces and bonded thereto;

whereby said pad will always be in shear and only be placed in tension or compression when relative movement between said ring and said yoke occurs and then, only when said relative movement has an axial component.

9. The vibration isolating mount of claim 8 wherein said yoke mounting means is constructed to mount objects on both sides of said yoke to thereby increase the total mass of mounted objects to provide increased vibration attenuation across said mount.

10. the vibration isolating mount of claim 8 wherein one of said ring and said yoke includes a snubbing projection and the other of said ring and said yoke include a snubber groove loosely receiving said projection.

* * * * *